US011132861B2

(12) United States Patent
Nelson et al.

(10) Patent No.: US 11,132,861 B2
(45) Date of Patent: Sep. 28, 2021

(54) SHARED GAME PRESENTATION ARRANGEMENT FOR GAMING SYSTEMS

(71) Applicant: Everi Games, Inc., Austin, TX (US)

(72) Inventors: Loren Nelson, Reno, NV (US); Steven Meyer, Austin, TX (US)

(73) Assignee: Everi Games, Inc., Austin, TX (US)

( * ) Notice: Subject to any disclaimer, the term of this patent is extended or adjusted under 35 U.S.C. 154(b) by 0 days.

(21) Appl. No.: 16/149,090

(22) Filed: Oct. 1, 2018

(65) Prior Publication Data

US 2019/0102981 A1 Apr. 4, 2019

Related U.S. Application Data

(60) Provisional application No. 62/567,091, filed on Oct. 2, 2017.

(51) Int. Cl.
*G07F 17/32* (2006.01)
*G07F 17/34* (2006.01)

(52) U.S. Cl.
CPC ..... *G07F 17/3213* (2013.01); *G07F 17/3223* (2013.01); *G07F 17/34* (2013.01)

(58) Field of Classification Search
CPC ... G07F 17/3213; G07F 17/3223; G07F 17/34
See application file for complete search history.

(56) References Cited

U.S. PATENT DOCUMENTS 6,786,824 B2 9/2004 Cannon
8,602,877 B2 * 12/2013 Carpenter ..... G07F 17/32 463/25
2007/0167217 A1 * 7/2007 Kaminkow ..... G07F 17/32 463/20
2009/0048012 A1 * 2/2009 Patel ..... G07F 17/3276 463/20
2011/0230251 A1 * 9/2011 Nicely ..... G07F 17/3239 463/20
2014/0243065 A1 * 8/2014 Wright ..... G07F 17/3274 463/16

* cited by examiner

*Primary Examiner* — Yingchuan Zhang
(74) *Attorney, Agent, or Firm* — The Culbertson Group, P.C.; Russell D. Culbertson

(57) ABSTRACT

A gaming system includes multiple second gaming machines, a shared display arrangement located in a viewable position relative to the different gaming machines, and a shared display server. Each gaming machine is operable to cause its gaming machine display system to display a first portion of a game play in response to a play initiating input entered through that gaming machine's player input system. Each gaming machine is also operable to initiate a hand-off communication for a given game play in response to a hand-off condition occurring for that game play. The shared display server receives the hand-off communication for a respective game play and supplies control signals to the shared display arrangement. The shared display server functions to, after receipt of a respective hand-off communication for a given game play, cause the shared display arrangement to display a presentation for a second portion of the respective game play.

15 Claims, 11 Drawing Sheets

SHARED GAME PRESENTATION ARRANGEMENT FOR GAMING SYSTEMS

CROSS-REFERENCE TO RELATED APPLICATION

Applicant claims the benefit, under 35 U.S.C. § 119(e), of U.S. Provisional Patent Application No. 62/567,091 filed Oct. 2, 2017, and entitled "Shared Game Presentation Arrangement for Gaming Systems." The entire content of this provisional application is incorporated herein by this reference.

TECHNICAL FIELD OF THE INVENTION

The invention relates to gaming systems and methods which provide a shared presentation arrangement for displaying portions of games entered through any one of several individual gaming machines.

BACKGROUND OF THE INVENTION

Modern gaming systems provide a wide variety of games in an effort to capture and maintain players' interest and enhance the playing experience. In addition to attractive and exciting graphics, games may offer bonus games in addition to a primary game available at a gaming machine. In the case of bonus games, play typically begins in a primary game and then moves to one or more levels of bonus games in response to some trigger in the course of play. Both primary and bonus games may provide some level of player interaction in addition to simply placing a wager and initiating play in the game.

Some prior gaming systems include a number of individual gaming machines which are associated with a shared display visible to players at each of the individual gaming machines. The shared display may comprise a large video display or a system of individual displays supported on a suitable structure above the individual gaming machines in position for players at the individual gaming machines to view images presented on the display or displays. This shared display may be used to provide group play information as described in U.S. Pat. No. 8,602,877. The shared display may also be used to present a feature event such as a live, reenacted, or simulated contest such as a horse race as described in U.S. Pat. No. 6,786,824.

There is a continuing need for wagering game systems which provide game presentation arrangements to enhance player experience and to encourage play at other gaming machines which may be unoccupied.

SUMMARY OF THE INVENTION

The present invention encompasses gaming systems and methods in which a portion of a game play initiated at a particular gaming machine in a bank of such gaming machines may be presented not at the gaming machine, but at a shared display arrangement. The shared display arrangement is located so as to be visible from the player position at all the gaming machines in the bank and has the effect of presenting portions of the games played at the bank of gaming machines to a larger audience and thereby generate interest in the games. In particular, presenting portions of the games in a larger format visible to a wider audience in the casino helps generate interest in the games and encourages others to participate by playing at any unoccupied gaming machine in the bank or in another bank of gaming machines associated with another shared display system embodying principles of the present invention.

A first aspect of the invention encompasses a gaming system including at least first and second gaming machines (and preferably more gaming machines), a shared display arrangement located in a viewable position relative to the different gaming machines, and a shared display server. Each gaming machine includes a respective gaming machine display system and gaming machine player input system. Each gaming machine is operable to cause its gaming machine display system to display a first portion of a game play in response to a play initiating input entered through that gaming machine's player input system. Each gaming machine is also operable to initiate a hand-off communication for a given game play in response to a hand-off condition occurring for that game play. The shared display server is operably connected for communication with each gaming machine to receive the hand-off communication for a respective game play and is also operably connected for supplying control signals to the shared display arrangement. The shared display server functions to, after receipt of a respective hand-off communication for a given game play, cause the shared display arrangement to display a presentation for a second portion of the respective game play. The second portion of one game play displayed for a given game play is distinct from the second portion of another game play in that the second portions of the different game plays represent different displayed events to show a result. That is, each displayed event representing the second portion of a given game play shows an outcome for the second portion of the given game play without showing an outcome for the second portion of any other game play. For example, the shared display arrangement may display a spinning reel-type game as the second portion of a given game play. Once the second portion of a given game play is complete at the shared display arrangement, the gaming machine associated with that game play awards any prizes associated with the first portion of the game play and the second portion of the game play, that is, the portions displayed at the gaming machine and at the shared display arrangement.

A second aspect of the present invention encompasses a shared game display system for a gaming system including two or more gaming machines connected to a communication system. Such a shared game display system (which may be abbreviated herein to "shared display system") includes a shared display arrangement and a shared display server as discussed above in connection with a gaming system according to the first aspect of the invention.

A third aspect of the present invention encompasses a method of presenting results in a gaming system. Methods according to this aspect of the invention include receiving play initiating inputs at different gaming machines, and responsive to each respective play initiating input, displaying a first portion of a respective game play with a display system of the respective gaming machine. Responsive to a shared display condition occurring for a given game play, the gaming machine for that game play makes a hand-off communication to shared display server as described for the first and second aspects of the invention. After receipt of the hand-off communication, methods according to this aspect of the invention include displaying a presentation for a second portion of the respective game play at a shared display arrangement as described above in lieu of displaying the presentation of the second portion of the game play at the respective gaming machine. Upon completion of the first and second portions of respective game play the method includes awarding a payout for the first and second portions of the game play though a payout system of the gaming machine at which the game play was initiated.

In a gaming system according to the first aspect of the invention and in methods according to the invention, each gaming machine may also be operable to cause the respective gaming machine display system to display a shared display system message when the shared display arrangement displays the presentation for the second portion of a game play initiated at that gaming machine. For example, the gaming machine display system may display a message for the player to direct their attention to the shared display arrangement.

Systems and methods according to the invention may also include the ability handling conflicts in hand-off communications to the shared display server from the various gaming machines. To address such conflicts the shared display server may also be operable to determine if the shared display arrangement is available to display the second portion of a given game play or is at that time occupied displaying the second portion of another game play. When the shared display arrangement is not available to display the second portion of the given game play, the shared display server may initiate a queuing communication to the respective gaming machine in response to receipt of a hand-off communication from that gaming machine. The gaming machine having initiated that hand-off communication may then be operable to respond to receipt of the queueing communication to cause the respective gaming machine display system to display a queuing message indicating a position in line for the shared display arrangement.

In some cases a player at one of the gaming machines may prefer not to wait for the shared display arrangement to be available to present the second portion of the game play. To address this situation a gaming machine according to aspects of the invention may also be operable to place a local play option control at the gaming machine in an activated stated in response to receipt of the queueing communication. A player may then make a local play input via the activated local play option control to cause the gaming machine to display the presentation of the second portion of the respective game play in lieu of presentation through the shared display arrangement.

In some embodiments according to the different aspects of the invention the second portion of a given game play may include an additional level of play which may be triggered by a suitable trigger in the second portion of the game play. In these embodiments the shared display server is also operable to cause the shared display arrangement to display a presentation of the additional level of the second portion of the given game play in response to the additional level trigger.

In any of the aspects of the invention the shared display arrangement may include at least three shared game display devices, and the presentation for the second portion of the game play may include a respective reel spin simulation at each shared game display device. The different shared game display devices in these embodiments are controlled by a control signal made up of separate video driving signals, one for each shared game display device to control the respective device to produce the desired reel spin simulation. Some embodiments of a gaming system according to the present invention may include three of more shared game display devices mounted to be viewable above a group of three or more gaming machines. This arrangement of gaming machines and shared game display devices may be configured back-to-back with another such arrangement of gaming machines and shared game display devices. A single shared display server may cooperate with each of the two back-to-back gaming machine and display device arrangements to provide the above-described shared display server functions for each such arrangement.

Because methods and systems according to the above aspects of the invention may be implemented through one or more general purpose or otherwise programmable processing devices, another aspect of the present invention encompasses program products storing program code. Program code stored on one or more non-transitory computer readable data storage devices according to this aspect of the invention may include shared display system communication program code and shared display system game program code executable by at least one processor of a shared display system. The shared display system communication program code is executable to receive the hand-off communications from gaming machines in the system. The shared display system game program code is executable to, responsive to a hand-off communication while the shared display arrangement is available, control the shared display arrangement to display a portion of the given game play. In the event the shared display arrangement is not available at the time a particular hand-off signal is received, the shared display system program code is executable to initiate the queueing communication to the gaming machine from which the hand-off communication was received for the given game play.

Program products according to the present invention may also include gaming machine program code. The gaming machine program code is executable by at least one processor of a gaming machine included in the shared display system to conduct a first portion of a given game play and to initiate hand-off communication as described above in response to a first hand-off condition occurring for that game play.

The gaming machine program code may also be executable to, upon completion of the given game play, award any prize resulting from the first portion of the game play and any portion of the game play displayed at the shared display arrangement.

These and other advantages and features of the invention will be apparent from the following description of representative embodiments, considered along with the accompanying drawings.

DESCRIPTION OF REPRESENTATIVE EMBODIMENTS

Figure 1:
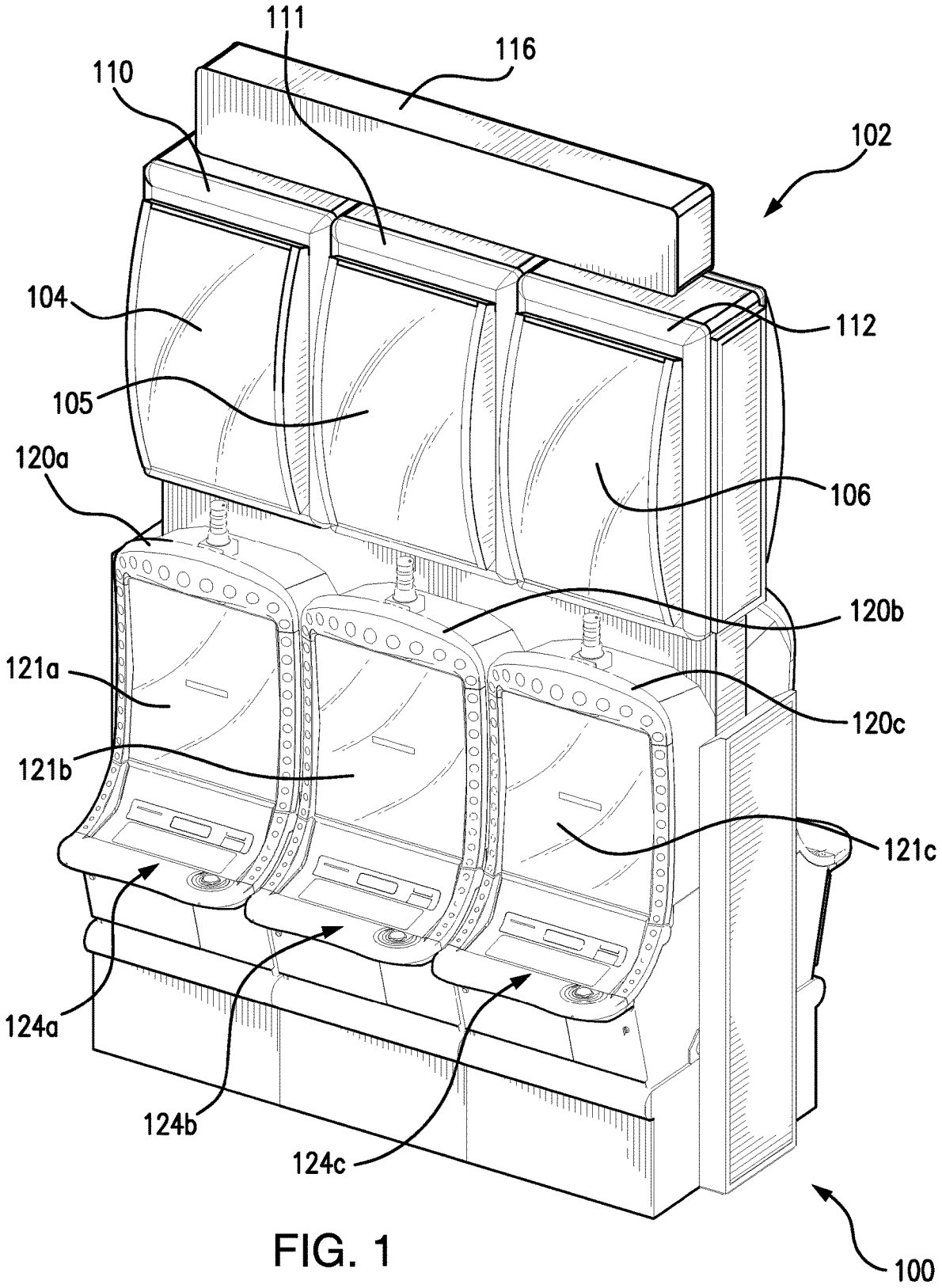
FIG. 1 is a perspective view of an example shared display gaming system embodying principles of the present invention.
Figure 2:
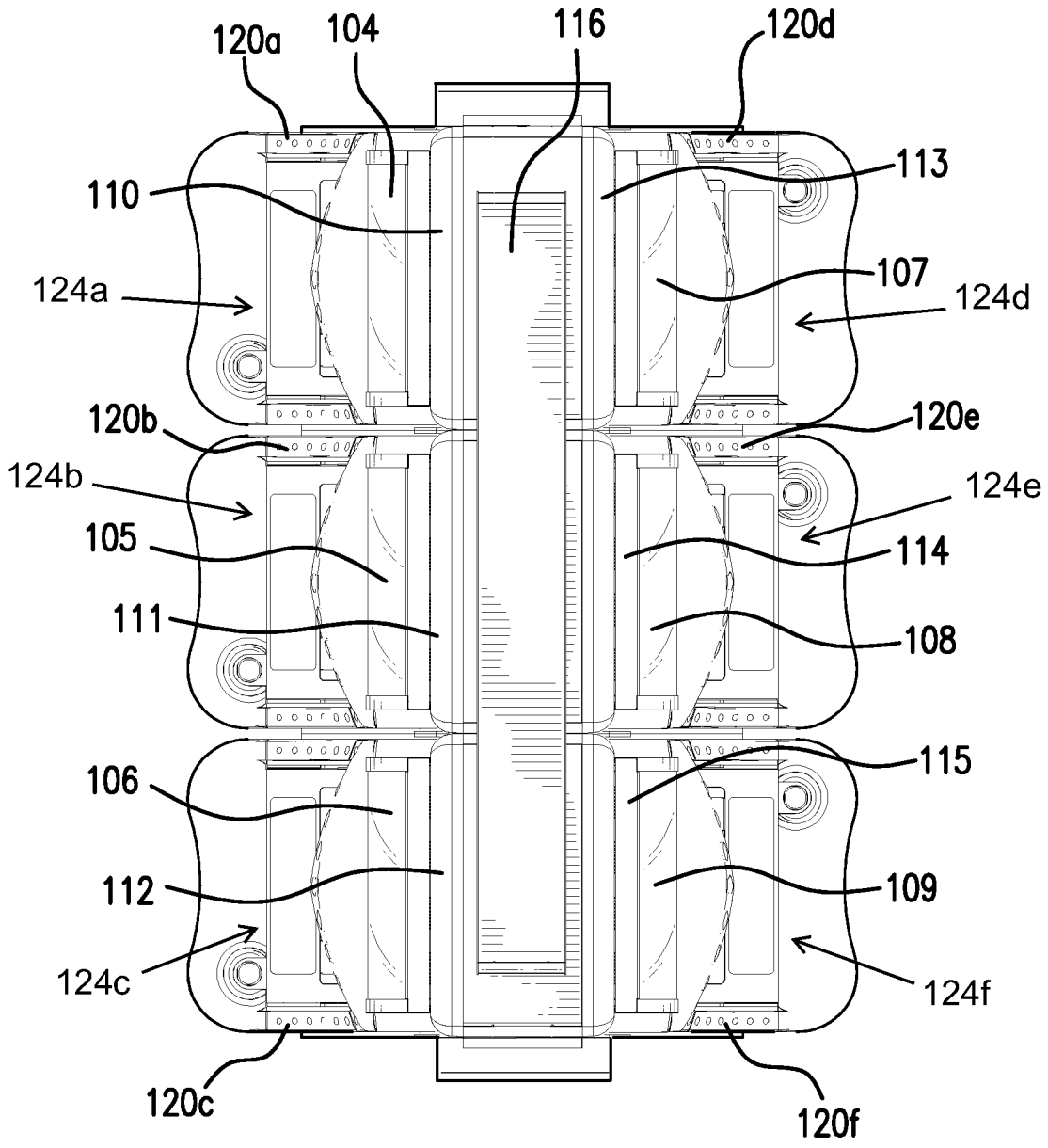
FIG. 2 is a top plan view of the shared display gaming system shown in FIG. 1.
Figure 3:
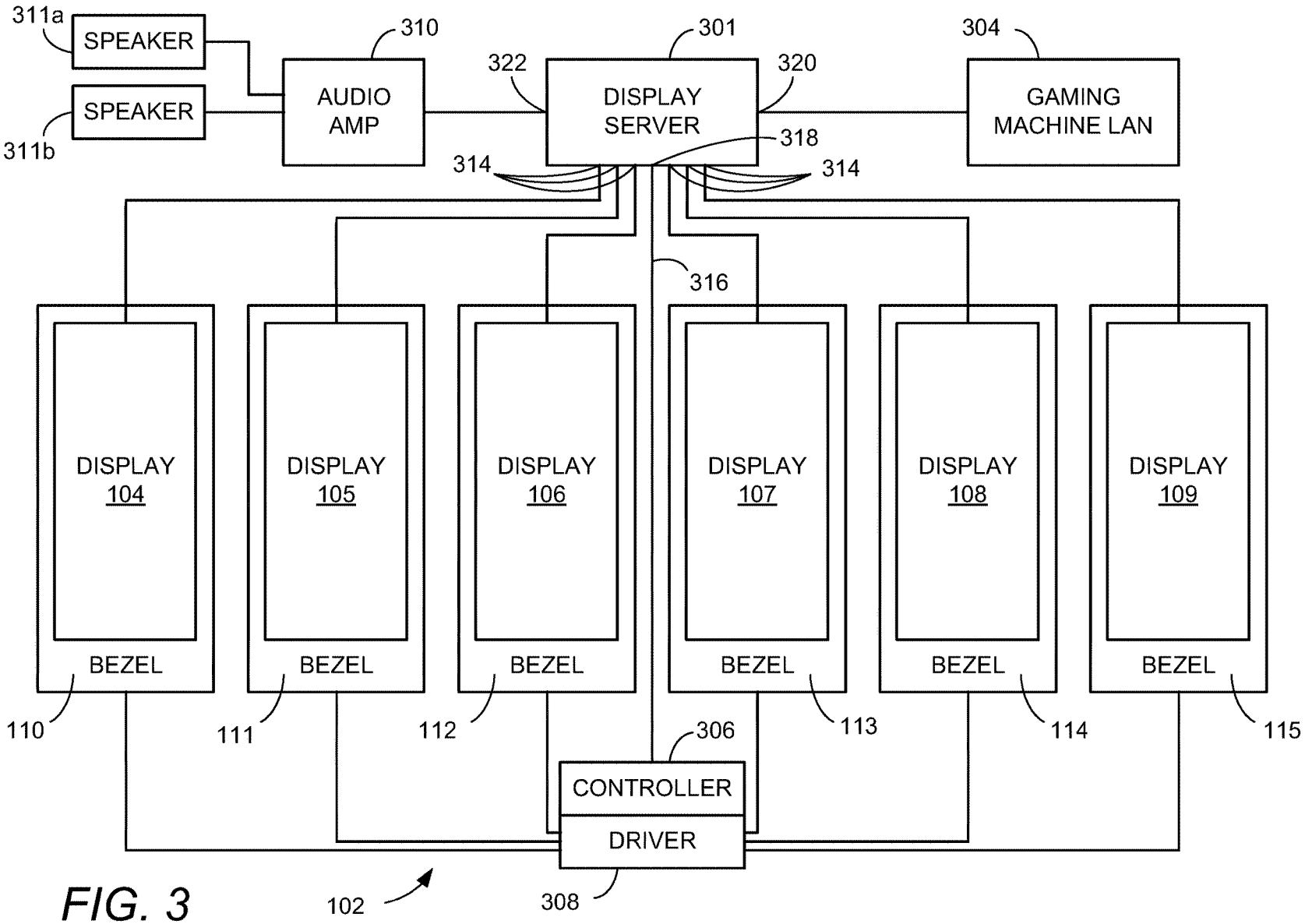
FIG. 3 is a block diagram of the shared display apparatus included in the shared display gaming system of FIG. 1.
Figure 4A:
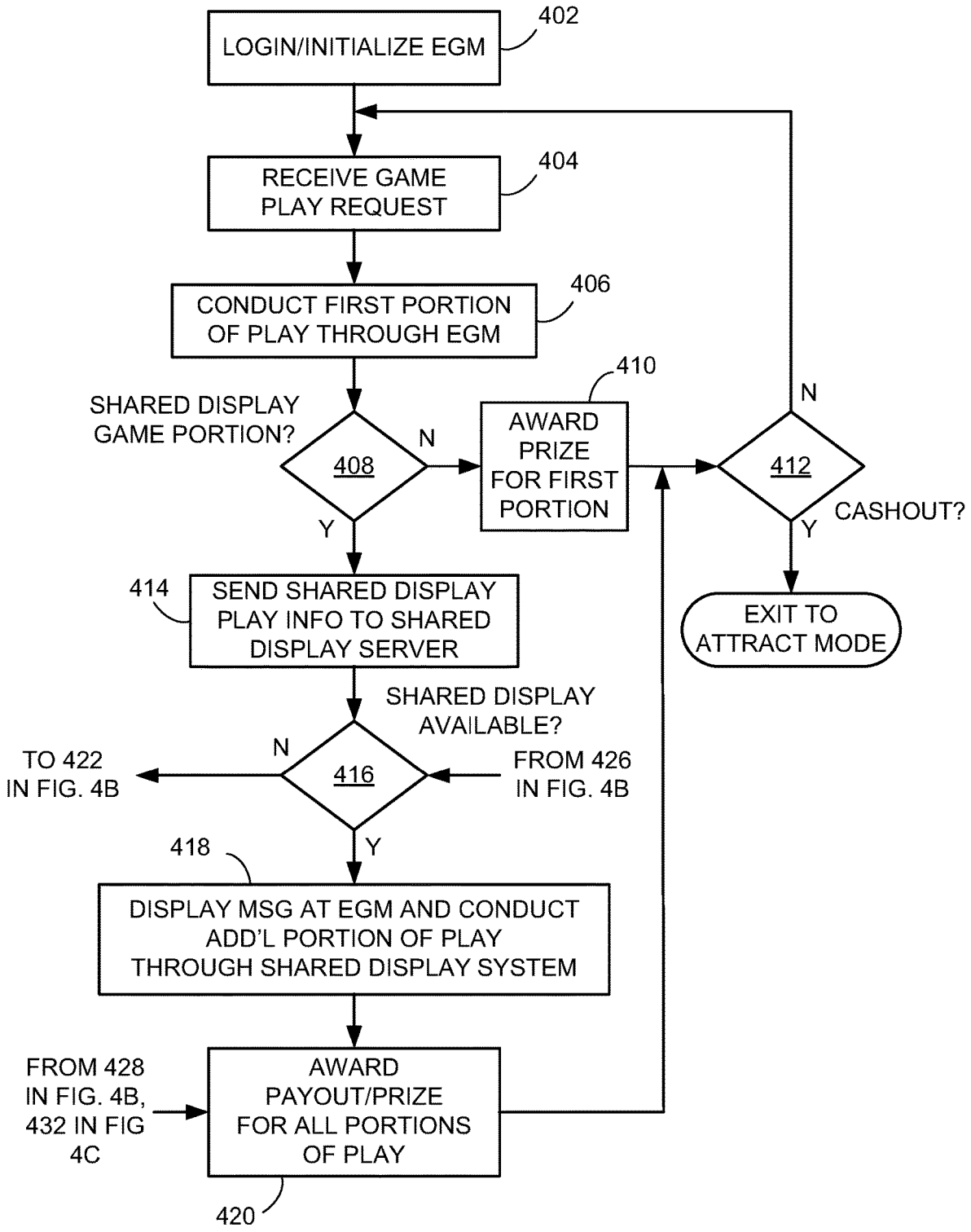
FIG. 4A is a process flow diagram showing a first portion of a process according to an aspect of the present invention.
Figure 4B:
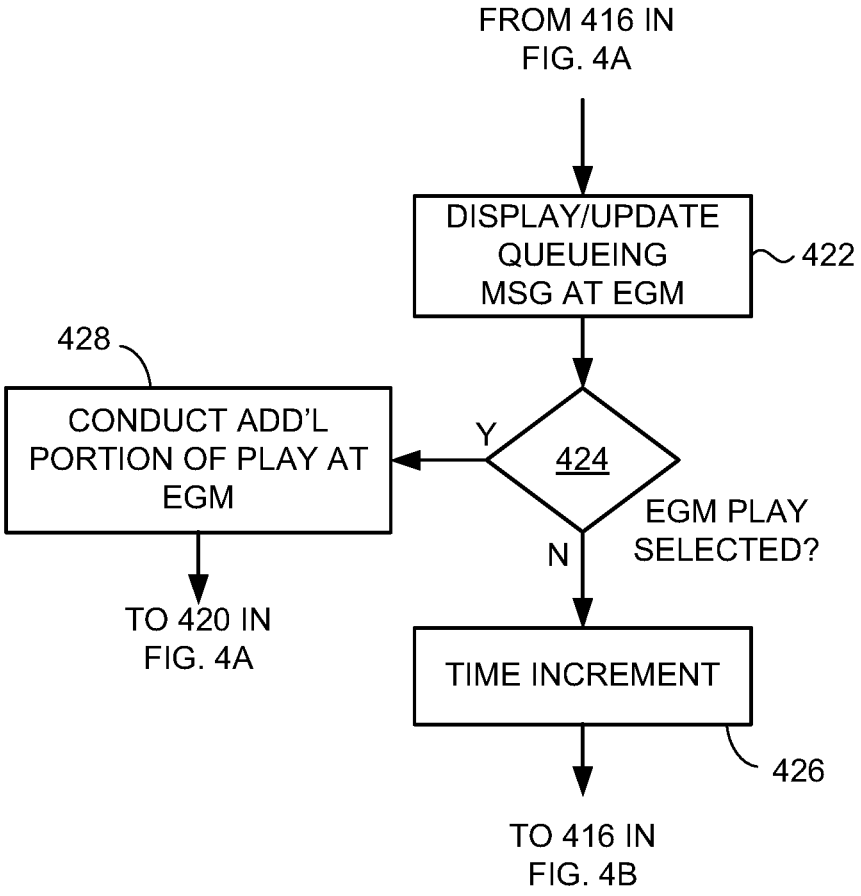
FIG. 4B is a process flow diagram showing a second portion of a process according to an aspect of the present invention.
Figure 4C:
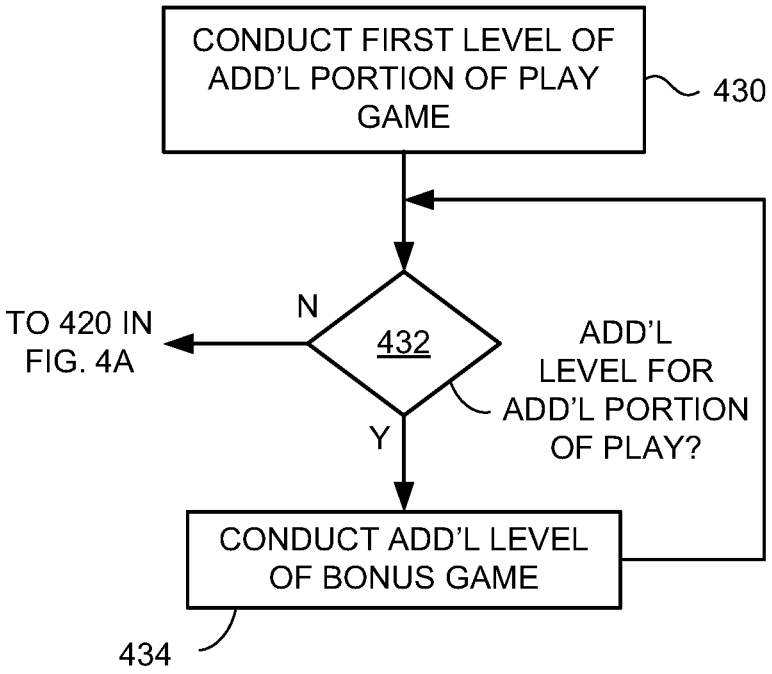
FIG. 4C is a process flow diagram showing an example bonus game process that may be employed for the bonus games indicated in FIGS. 4A and 4B.
Figure 7:
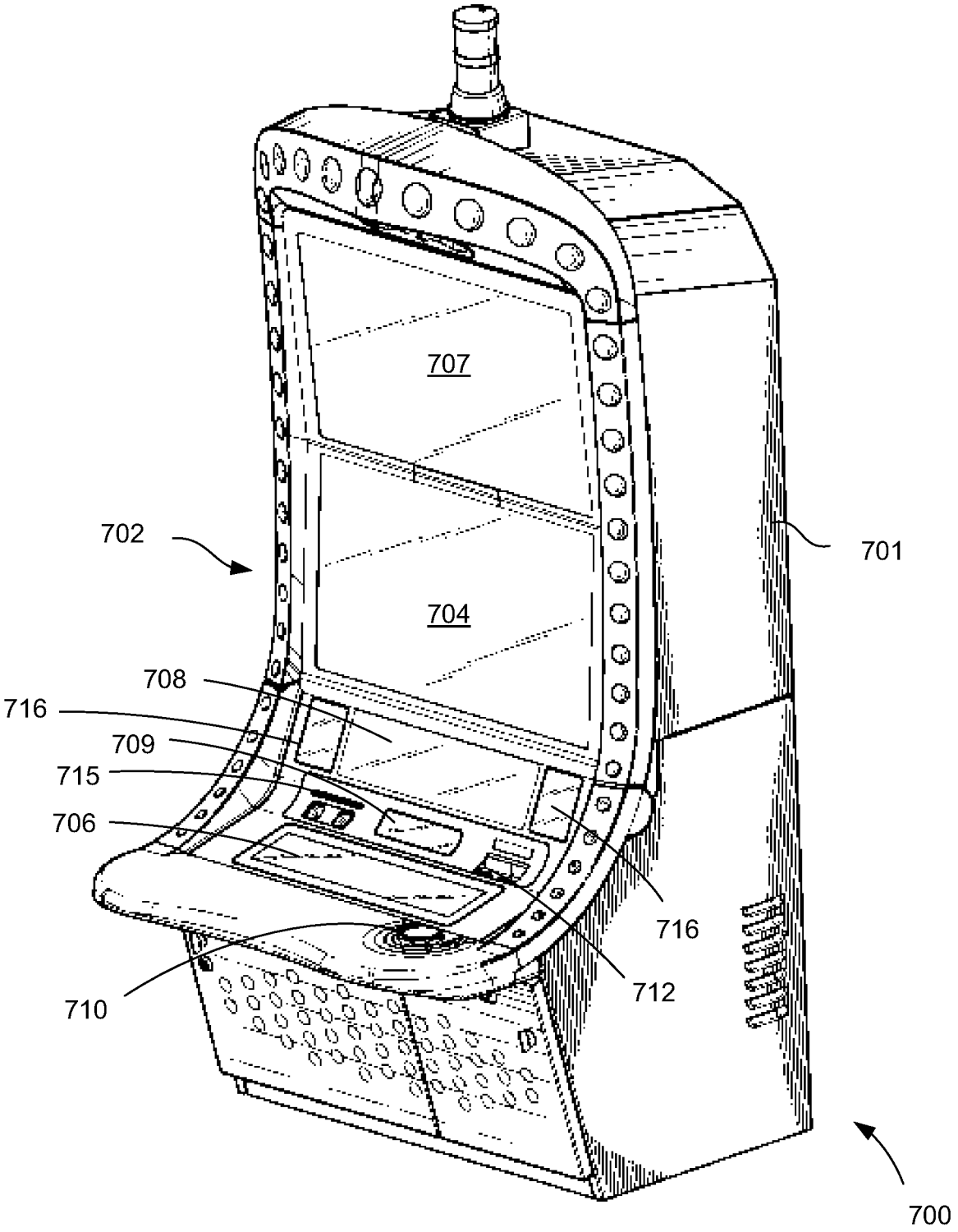
FIG. 7 is a perspective view of a gaming machine that may be used in a shared display gaming system in accordance with implementations of the present invention.
Figure 8:
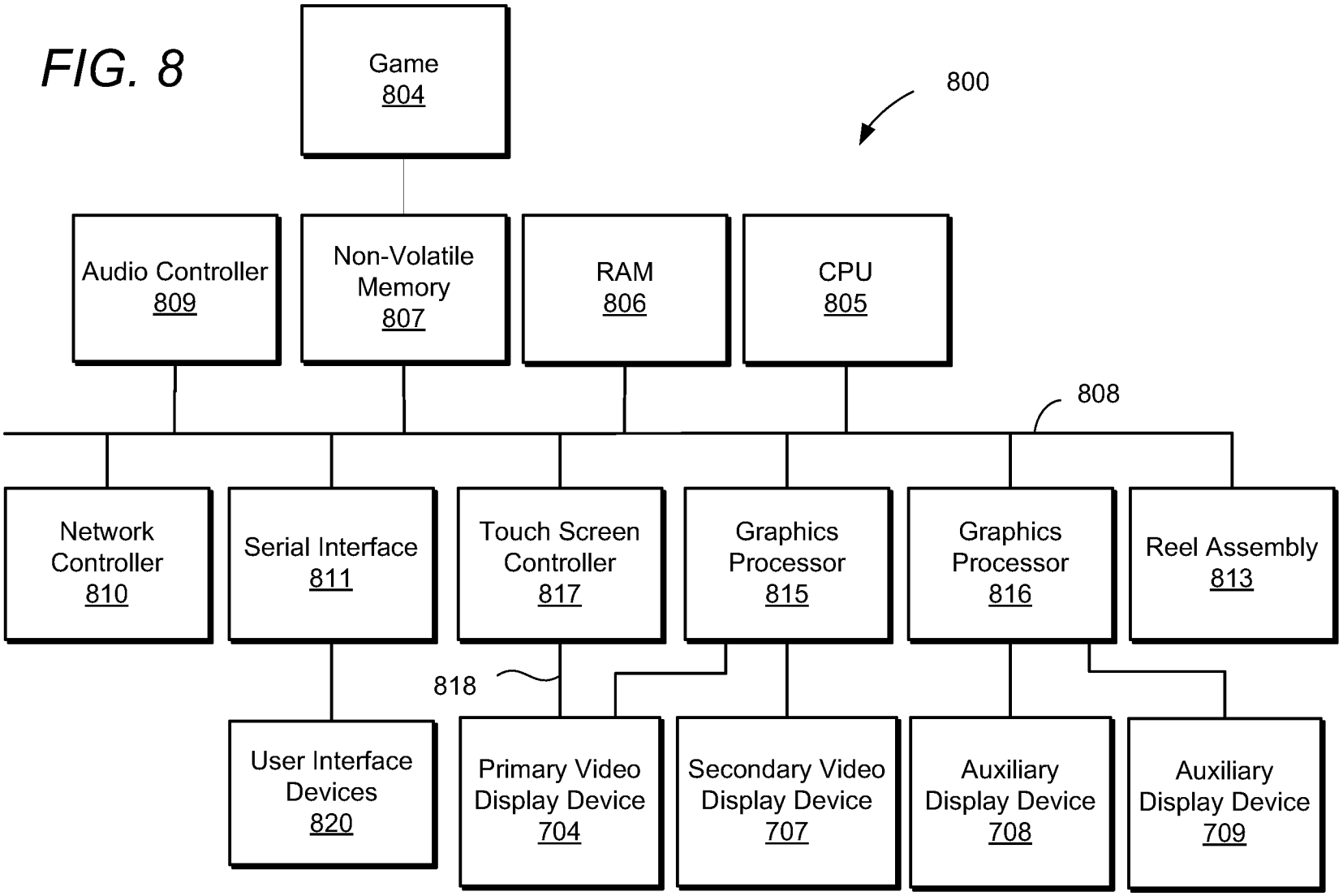
FIG. 8 is a block diagram showing the various components that may be included in the gaming machine shown in FIG. 7.
Figure 9:
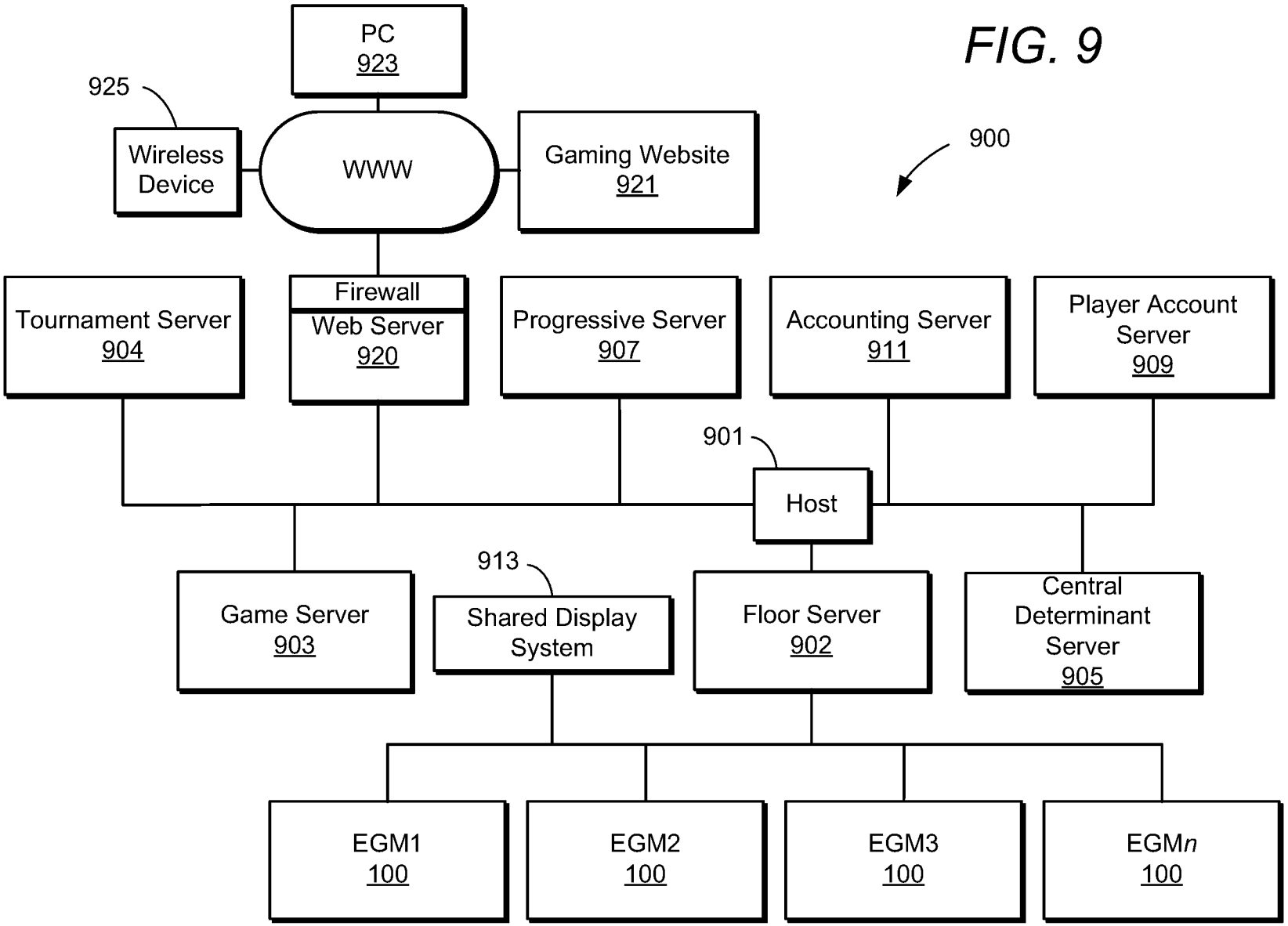
FIG. 9 is a block diagram of a gaming system including gaming machines such as that shown in FIG. 7 and a shared display gaming system in accordance with the present invention.

FIGS. 1-3 will be referenced below to describe an example gaming system and shared display system according to the present invention. FIGS. 4A, 4B, and 4C will be referenced to describe example methods of conducting games partially through display devices shared between several different gaming machines, while FIGS. 5 and 6 will be referenced to describe example plays in a shared display gaming system. FIGS. 7 through 9 will be referenced below to describe an example gaming machine and gaming system in which the present invention may be implemented.

FIGS. 1 and 2 show a bank 100 of gaming machines together with a shared display system 102. Shared display system 102 is mounted above the back-to-back mounted gaming machines which are included in bank 100, and includes a number of displays 104, 105, 106, 107, 108, and 109. Each display in this implementation is associated with a lighted bezel structure including bezels 110, 111, 112, 113, 114, and 115. Shared display system 102 further includes a top sign 116 in this illustrated embodiment. The gaming machines (which may be referred to in this disclosure as "EGMs"), include gaming machines 120*a*, 120*b*, 120*c*, 120*d*, 120*e*, and 120*f*. Each gaming machine 120*a-f* includes a respective display device (or an arrangement of separate display devices). Display devices 121*a*, 121*b*, and 121*c*, corresponding to gaming machines 120*a*, 120*b*, and 120*c*, respectively, are shown in FIG. 1. It will be appreciated that display devices will similarly be included with gaming machines 120*d*, 120*e*, and 120*f* although these display devices are not shown in the perspective of FIG. 1 or top view of FIG. 2. Also, each gaming machine 120*a-f* includes a respective player input system shown generally in the figures at 124*a*, 124*b*, 124*c*, 124*d*, 124*e*, and 124*f*. Further details of the gaming machines 120*a-f* will be described below in connection with FIGS. 7 and 8, while a gaming network in which the gaming machines may be connected will be described in connection with FIG. 9.

The displays 104-109 of shared display system 102 each comprise a convex curved display device and may be constructed according to any suitable display technology now known or developed in the future. The convex curvature in this embodiment helps the displays to each imitate a physical reel such as a reel of a slot machine. However, implementations of the invention are not limited to the illustrated types of displays with convex curvature or to any number of displays. More or fewer displays may be included above a set of two or more gaming machines such as gaming machines 120*a-c*. Regardless of the type or number of displays for a set of side-by-side gaming machines, the shared display or displays should be positioned in a viewable position relative to each gaming machine, that is, so that a player at any of the gaming machines may conveniently direct their attention to the shared displays rather than to the display(s) of the player's respective gaming machine. It will also be appreciated that in the example shared display system 102, displays 104, 105, and 106 may be used to display portions of plays initiated at the gaming machines 120*a-c* on that side of bank 100 while displays 107, 108, and 109 may be used to display portions of plays initiated at the gaming machines 120*d-f* on that side of the bank. Where the gaming machines must be placed against a wall due to casino floor space limitations, the arrangement shown in FIGS. 1-2 may be modified to include, for example, gaming machines 120*a-c* and display devices 104, 105, and 106 with no gaming machines or shared display devices facing the opposite direction.

FIG. 3 shows various electronic components of shared display system 102 which are preferably housed in the structure shown in FIGS. 1 and 2 together with the displays 104-109, and bezels 110-115. In particular shared display system 102 includes a display server 301 connected for communication to a local area network represented schematically at box 304. Display server 301 (which comprises a suitable data processing device including one or more data processors) is also connected to communicate with a controller 306 which controls a driver circuit or arrangement of circuits 308 for driving lights associated with the bezels 110-115. Display server 301 is also connected to provide an audio signal to audio amplifier 310 which drives speakers 311*a* and 311*b*.

Display server 301 is shown as having six separate video output ports 314, which may be DisplayPort™ compliant ports for example, for providing a video signal to each of the displays 104-109. The communication path 316 to controller 306 may comprise a serial communication path connected to a suitable serial output port 318 of display server 301. The communication link to the local area network 304 is preferably an Ethernet link connected to an Ethernet port 320 of display server 301, while the audio output is provided through an audio output jack 322 associated with the display server. The gaming machine LAN 304 shown in FIG. 3 is included to indicate that all of the gaming machines 120*a-f* (shown in FIGS. 1 and 2) are also connected via Ethernet in this example to display server 301. Although the simplified schematic diagram shown in FIG. 3 shows only a single connection from the driver 308 each bezel 110-115, it will be appreciated that each bezel may itself be divided up into separate bezel lighting sections which are each separately controllable to provide lighting effects around each respective display 104-109. The simplified schematic of FIG. 3 also omits power supplies which are necessary for supplying the appropriate operating power to the various illustrated electronic components. Such power supplies are well known in the art as are the power connections needed to distribute power to the various devices, and thus these elements are omitted from the drawings so as not to obscure the invention in unnecessary detail. Display server 301 may comprise any suitable processing device capable of providing a shared display control signal to the shared display arrangement, in this case the control signal comprising respective display driving signals for the displays 104-109, and providing the other functionality described further below in connection with the flow diagrams FIGS. 4A, 4B, and 4C. For example, the display server may comprise one or more Quixant™ model QX-40 gaming processing systems. This example processing device and similar processing devices may execute the shared display system communication program code to receive the hand-off communications described below and direct shared display system messages, queueing messages as described below.

Example processes for providing a shared display game presentation according to aspects of the present invention may be described with reference to the process flow diagrams of FIGS. 4A-4C. Referring first to FIG. 4A, after an initial login or otherwise initializing the gaming machine (such as any of gaming machines 120*a-f* in FIGS. 1 and 2 for example) for play as shown at process block 402, a game play request (a game play initiating input) is received at the gaming machine as shown at process block 404. This game play request may, for example, be received through a player input system associated with the gaming machine such as the player input system described below in connection with the example gaming machine shown in FIG. 7. The game play request will typically be associated a wager amount which has been selected by the player through the player input system and will be entered by pressing or otherwise activating a "Play" button at the gaming machine, or pulling a play initiating handle at the gaming machine. Regardless of how the game play request is entered or received, in response to the game play request, the method includes conducting a first portion of a play in the game (that is a first portion of a "game play") through the respective gaming machine as shown at process block 406. In the course of the first portion of the game play performed at process block 406, a condition may be detected indicating that the game play includes a second portion to be conducted by a shared display system such as system 102 in FIGS. 1 and 2. Such a condition may be referred to as a "hand-off condition" indicating a hand-off to the shared display system is to occur for the game play. If no shared display portion of the game play is detected for a given game play as indicated by negative outcome at decision box 408, the process proceeds to award any prizes for the game play at process block 410. If the player does not cash out at the gaming machine as indicated by a negative outcome at decision box 412, the process loops back to receive the next game play request at the given gaming machine at process block 404. If the player does cash out, the gaming machine is placed in an attract mode to wait for login/initialization by another player.

In the event a second portion of the game play is detected as indicated by an affirmative outcome at decision box 408, the process includes sending shared display play information from the gaming machine to the shared display server (301 in FIG. 3) as shown at process block 414 to enable the shared display server to provide the second portion of the game play. In the event the shared display system (102 in FIGS. 1-3) is available at that time to immediately show the second portion of the game play as indicated by an affirmative outcome at decision box 416, the process includes displaying an appropriate message at the requesting gaming machine and then conducting the second portion of the game play through the shared display system as indicated at process block 418. Once the second portion of the game play is complete, any prize for the game play, that is, both the first and second portions of the game play, are awarded as indicated at process block 420 and the process loops back to the cash out decision box 412.

In the event the shared display system (102 in FIGS. 1-3) is not available to immediately conduct the second portion of the given play as indicated by a negative outcome at decision box 416, the process moves to the portion of the process shown in FIG. 4B. For example, the shared display system may be currently occupied providing a second portion of another game play from another gaming machine (120*a-f* shown in FIGS. 1 and 2) and thus unavailable to conduct the instant second portion of the game play. As shown at process block 422 in FIG. 4B, the process includes displaying and perhaps updating a queueing message at the gaming machine for which the game play request was received at process block 404 in FIG. 4A. The queueing message may include an option for the player to opt out of the second portion of the play through the shared display system and rather conduct the additional portion of the play at the gaming machine. If local play at the gaming machine is selected as indicated by an affirmative outcome at decision box 424, the process proceeds to conduct the additional portion of the play at the respective gaming machine as indicated at process block 428 and thereafter return to the awarding step at process block 420 in FIG. 4A. However, if local play at the individual gaming machine is not selected as indicated by negative outcome at decision box 424 (or if no local play option is provided), the process includes simply waiting until the shared display system is available. This process may include waiting for some time period as indicated at process block 426 in FIG. 4B and then checking for shared display availability again after the incremental time period as indicated by the return to decision box 416 in FIG. 4A.

It will be appreciated that the process shown in FIGS. 4A and 4B may be performed for each game play initiated through one of the gaming machines (such as gaming machines 120*a-f* in FIGS. 1 and 2) for which shared display presentation is supported. Thus multiple instances of this process may be in execution at any given time in the example system shown in FIGS. 1-3. The process steps shown in FIG. 4A at blocks 402, 404, 406, 408, 410, and 412 may all be performed by the respective gaming machine such as any of the gaming machines 120*a-f* shown in FIGS. 1 and 2, under the control of gaming machine program code. The step of sending play information to the shared display server at 414 in FIG. 4A is also preferably performed by the gaming machine at which the game play request was received. In the system shown in FIGS. 1-3, the communication at process block 414 may be an Ethernet communication from the respective gaming machine 120*a-f* to display server 301 in FIG. 3, and may represent a hand-off communication to facilitate the presentation of the additional portion of the play at shared display system 102. The communication may include a request to conduct the second portion of the ongoing play for the gaming machine and information (if any additional information is needed for a given implementation) to allow the shared display server to conduct the remaining portion of the game play. For example, the second portion of the game play may be a bonus game which may be performed and displayed through the appropriate display devices (display devices 104, 105, and 106 or 107, 108, and 109) on that gaming machine side of the bank controlled by the display server 301. In some implementations of the invention, the amount to be awarded or shown as being awarded for the second portion of the game play to be displayed at the shared display system is determined by the gaming machine or by a result server separate from the gaming machine and this information is included in the communication at process block 414. It is also possible in some implementations of the invention for the shared display system 102 to determine the outcome and any prize associated with that portion of the play or to obtain the outcome from a result server in a separate communication with such a server. In these cases the communication at process block 414 may simply include a request for the shared display system to conduct the second portion of the game play.

In cases where the shared display system (102 in FIGS. 1-3) is unavailable to immediately conduct the second portion of the game play, the process may include a communication from the display server 301 back to the requesting gaming machine in response to the request at process block 414. Such a communication back from the display server 301 may include information to allow an appropriate message to be displayed to the player at the gaming machine, in particular, the queueing message displayed as indicated at process block 422 in FIG. 4B. In cases where the shared display system 102 is immediately available to conduct the additional portion of the game play, a communication to that effect back from the display server 301 will also allow the respective gaming machine to present a message appropriate for that condition. Example queueing and other messages will be described in connection with an example implementation in connection with FIGS. 5 and 6 below.

The communications required to allow the award indicated at process block 420 to be performed at the respective gaming machine (the EGM having received the game play initiating input at process block 404) will depend upon how results are obtained in the particular system. In cases where the gaming machine has determined or otherwise obtained the overall prize for the game play including the portion conducted at the shared display system, display server 301 need only communicate back to the gaming machine an indication that the additional portion of the play is complete. Once the gaming machine receives this indication, it may proceed to award the prize as indicated at process block 420. However, in cases where the result of the second portion of the play conducted through the shared display system is performed by the shared display server or another result server, server 301 or that additional server may also communicate the result back to the gaming machine so that the award may be made as indicated at process block 420. In any event it should also be noted that since the process shown in FIGS. 4A and 4B may be performed for each game play initiated through a respective gaming machine (e.g., 120*a-f* in FIGS. 1 and 2) the payout or prize awarded at block 420 for a given game play is independent of any portion of game play conducted for another gaming machine in the system. In particular, this independence for a given game play means that the conduct of the portion of play through the shared display system as indicated at process block 418 in FIG. 4A has no effect on a game play initiated at a different gaming machine and no effect on any payout or prize for a game play initiated at a different gaming machine.

The awarding steps shown at 410 and 420 in FIG. 4A may be performed in any suitable fashion either by the respective gaming machine itself or by the gaming machine in cooperation with other elements in a gaming system in which the gaming machine is included. Whether the gaming machine cooperates with some other element (such as an accounting server, for example) or not, the awarding step will typically include adding credits or other value to a player's credits/value displayed at the gaming machine. In other cases the awarding steps indicated in FIG. 4A may include issuing a physical prize at the gaming machine or a physical or electronic voucher which may be redeemed for a physical prize. The present invention is not limited to any particular method for awarding payouts or prizes as indicated at blocks 410 and 420 in FIG. 4A, or to any particular types of payouts or prizes.

Some implementations of the invention may include different levels for the additional portion of the play that may be performed through the shared display system. Such an arrangement is indicated in the process shown in FIG. 4C. The process includes conducting the initial level of the game play at the shared display system (102 in FIGS. 1-3) as indicated at process block 430. In the event there is an additional level as indicated by an affirmative outcome at decision box 432, the process proceeds to conduct the additional level of the game play as indicated at process block 434. This decision loop may be performed multiple times if there are further levels of play. In any event, when there is no additional level of the game play as indicated by negative outcome at decision box 432, the process returns to process block 420 in FIG. 4A to award the prize for the play. An example of an additional level of play will be described below in connection with FIG. 6.

Numerous variations are possible within the scope of the present invention in the example processes shown in FIGS. 4A-4C. For example, although the process flow and the above discussion refers to a "first" portion of a game play and a "second" portion of the game play, the break between portions of a game play conducted at a gaming machine and the shared game display system may be at any point in a given game play and is irrespective of events or portions of the game play. For example, although the first portion of a given game play may reach at least part of an overall outcome for the game play as indicated by the process shown at FIG. 4A, embodiments according to the various aspects of the invention may not reach any outcome in the first portion of the game play. In some cases, the first portion of a given game play displayed at the gaming machine may be very brief and may include only an indication that the play has moved to the second portion potentially presented via the shared display arrangement. It is also possible within the scope of the present invention for a given game play to be made up of more than two portions, and the "first portion" described above in reference to the figures and referenced in the following claims may be any portion of the game play (a second, third, fourth, etc. portion of a game play) and not just an initial portion of the game play, and the "second portion" described above and in the claims may be any part of the game play after the "first portion." It is also possible for a gaming machine in a gaming system according to the invention to conduct additional portions of a given game play after the "second portion" is conducted through the shared game display system.

Numerous variations are also possible for the hand-off condition upon which the operation at decision box 408 in FIG. 4A turns. The hand-off condition may be a trigger occurring in the first portion of the respective game play which triggers a bonus game and this bonus game may comprise the second portion of the game play to be conducted potentially through the shared game display system 102 in FIGS. 1-3. Alternatively, the hand-off condition may be dictated for a given game play independent of any result in the first portion of the game play. In some implementations of a shared display system according to aspects of the present invention, a hand-off condition for a game play initiated as indicated at 404 in FIG. 4A may be suppressed based on the availability of the shared display system to conduct the second portion of the game play without significant delay. In these implementations, determining whether the shared display system is available as indicated at decision box 416 in FIG. 4A may be performed immediately after the inquiry indicated at decision box 408 in FIG. 4A rather than as illustrated. If the shared display system is available in these embodiments, the second portion of the game play would be conducted through the shared display system as indicated at process block 418 in FIG. 4A.

Otherwise, the second portion of the game could be conducted at the gaming machine, or might not be conducted at all. These arrangements for suppressing hand-off conditions to prompt the conduct of a second portion of a game play at the shared display system may be used to help prevent undesirable delays in the game plays, while retaining the benefits of shared display system.

Figure 5:
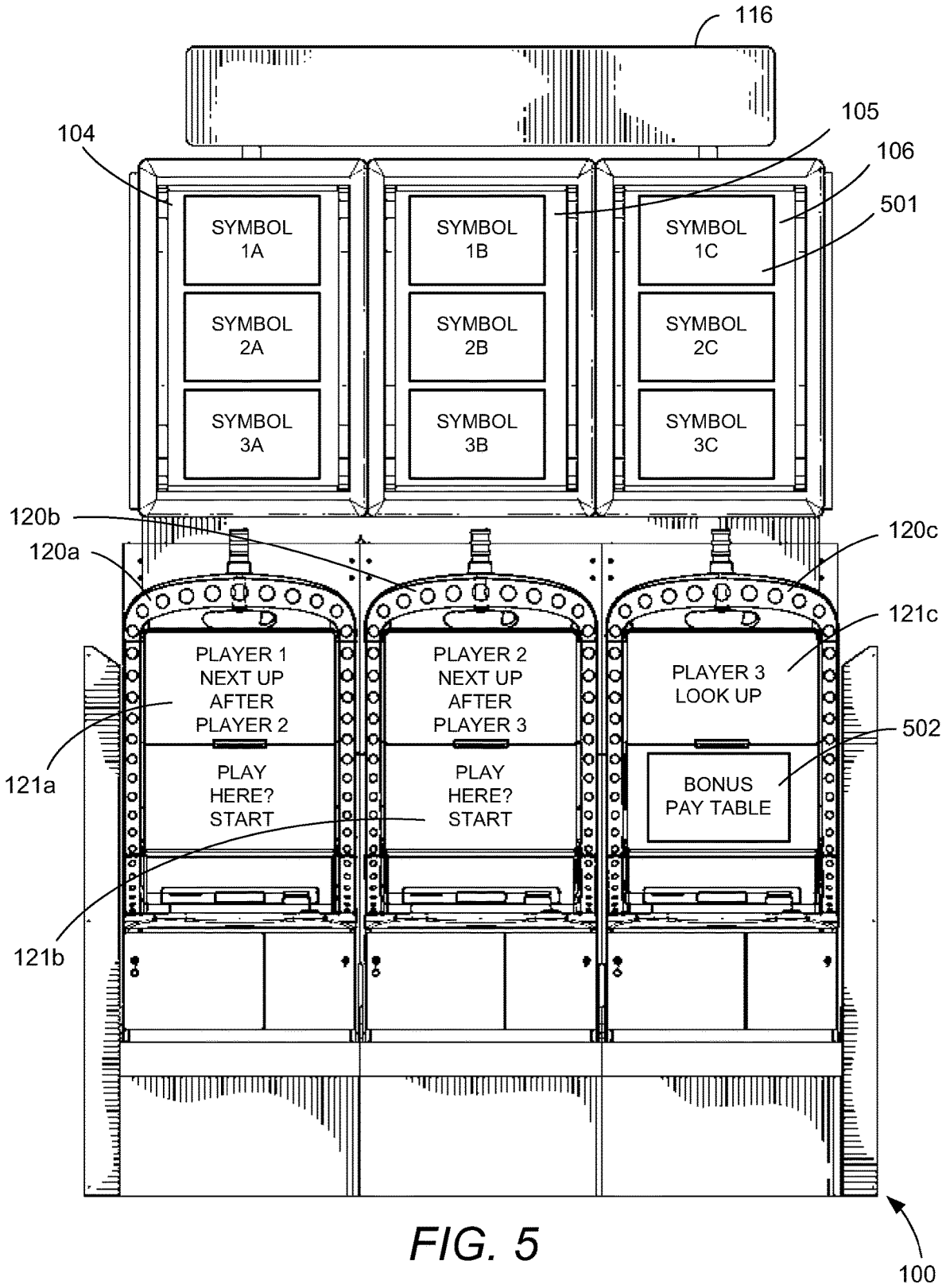
FIG. 5 is a partially schematic representation of a state of a bonus game conducted through the shared display gaming system shown in FIGS. 1 and 2.

FIG. 5 provides a representation of a shared display game conducted through the system shown in FIGS. 1 and 2. In this example the second portion of the game play for gaming machine 120*c* is being conducted by the shared display system 102 and displayed through each of displays 104, 105, and 106. In particular FIG. 5 shows the state of the process at process block 418 in FIG. 4A as to a game play request received as at block 404 in that figure at gaming machine 120*c*. The message displayed at the gaming machine comprises the message "PLAYER 3 LOOKUP" to draw the player's attention to the portion of the play being conducted by the shared display system. In this example displays 104, 105, and 106 are driven to represent individual reels of a reel-type game and ultimately show symbols coming to rest at three different symbol positions on the respective display. This produces a matrix of game symbols 501 which are used to convey the result of the second portion of the game play to the player as in a reel-type game. It will be noted that the gaming machine 120*c* for which the shared display system 102 is showing a portion of the play also displays a separate pay table 502 for that portion of the play. This may be an entirely or partially different pay table from that effect for the first portion of the game play. The reel-type game shown as the second portion of the game play conducted at shared display system 102 may be a single payline game in which a single payline is defined through the matrix of game symbols 501 in FIG. 5 (for example symbols 2A, 2B, and 2C). Alternatively the play could be for a multi-payline game. Scatter pays and other features common in reel-type games may also be defined for the portion of the play shown by the shared display system 102. Also, the second portion of the game play initiated at a respective gaming machine need not be reel-type games, but could be any game in which results for a wager may be displayed and may vary from one gaming machine in the system to another.

Gaming machines 120*a* and 120*b* are both at the state of the process indicated at process block 422 in FIG. 4B. The queuing message displayed for gaming machine 120*b* indicates that the gaming machine is next in line after the play provided for gaming machine 120*c*, that is the gaming machine for player 3 in this bank of gaming machines. The queuing message at gaming machine 120*a* indicates that the gaming machine is last in line for the shared display system 102. Both of the queuing messages displayed for gaming machines 120*a* and 120*b* provide a way for the player to opt out of showing the second portion of the game play at the shared display system 102. Each display (121*a* and 121*b*) provides a message "PLAY HERE?" and then a label "START." This "START" label may be at a touchscreen portion of the respective display device so as to allow a player to simply touch the area of the "START" label to initiate the additional portion of the play at the gaming machine as opposed to the shared display system. Otherwise a mechanical or virtual button or some other control may be activated and may be operated by the player to start the second portion of the game play at the gaming machine as opposed to the shared display system 102. This is in accordance with the process shown at box 428 in FIG. 4B after an affirmative outcome from decision box 424 in that figure.

Figure 6:
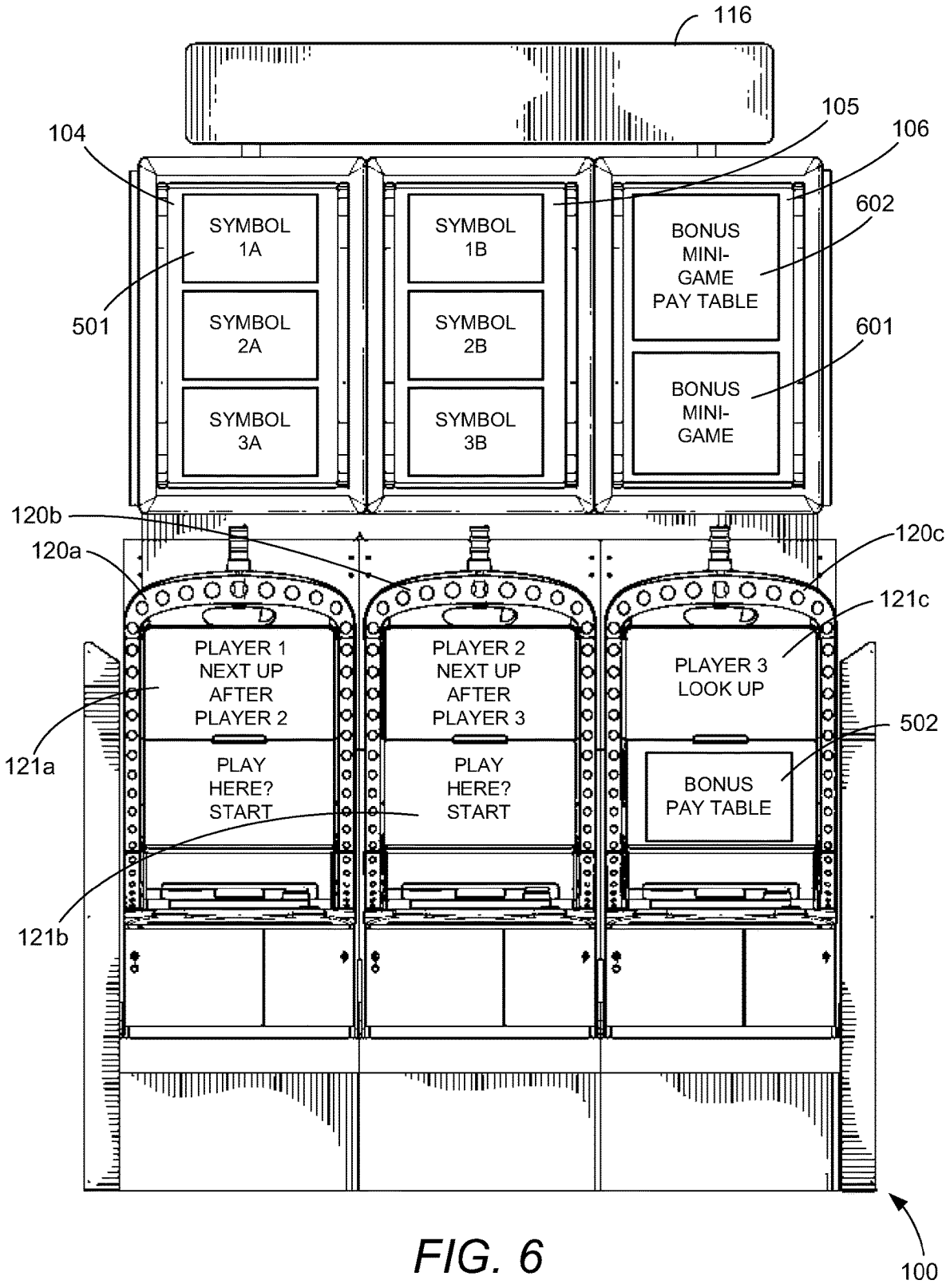
FIG. 6 is a partially schematic representation of a second state of a bonus game conducted through the shared display gaming system shown in FIGS. 1 and 2.

FIG. 6 shows the state of the gaming system including shared display system 102 and gaming machines 120*a-c* in which an additional level of play is available for the portion of the play conducted at the shared display system 102. In this example, the additional level of play includes a bonus mini-game which is shown at area 601 in a lower portion of display 106 which is the display immediately above gaming machine 120*c*. A pay table 602 for the bonus mini-game is also shown on display 106 in the course of the bonus mini-game in this example. The bonus mini-game may be a reel-type game or any other type of game that may be portrayed on a video display device in the area 601 of FIG. 6. Of course, if the player selects to play the additional portion of their current play at the gaming machine rather than through the shared display system 102, any additional level game such as the bonus mini-game would be conducted at the player station in accordance with FIG. 4B rather than through system 102.

Referring to FIG. 7, gaming machine 700, which may be used as any of the gaming machines 120*a-f* in FIGS. 1 and 2, includes a cabinet 701 having a front side generally shown at reference numeral 702. A primary video display device 704 is mounted in a central portion of the front side 702, and a touch-screen button panel 706 is positioned below the primary video display device. In addition to primary video display device 704, the illustrated gaming machine 700 includes a secondary video display device 707 positioned above the primary video display device. Gaming machine 700 also includes two additional smaller auxiliary display devices, an upper auxiliary display device 708 and a lower auxiliary display device 709. It should also be noted that each display device referenced herein may include any suitable display device including a cathode ray tube, liquid crystal display, plasma display, LED display, or any other type of display device currently known or that may be developed in the future. One or more of these video display devices, and especially video display devices 704 and 707, may be used to display messages and information associated with the operation of shared display system 102 in addition to graphics associated with a first portion of a play conducted at the gaming machine, and graphics associated with awarding step shown in FIG. 4A at 420. As will be described further below in connection with FIG. 8 and elsewhere, it is also possible for gaming machines within the scope of the present invention to include mechanical elements such as mechanical reels. Generally, the display device or display devices of the gaming machine, through which a play in a game may be presented in accordance with the present invention may be described in this disclosure and the accompanying claims as a "display system."

The gaming machine 700 illustrated for purposes of example in FIG. 7 also includes a mechanical control button 710 mounted adjacent to touch-screen button panel 706. This control button 710 may allow a player to make a play input to start a play in a wagering game conducted through gaming machine 700, while virtual buttons included (but not shown in this view) on button panel 706 or other physical buttons or controls may allow a player to select a bet level for a game implemented at the gaming machine and select a type of game or game feature. Touch-screen button panel 706 may also be used in implementations of a shared game presentation arrangement according to the present invention for making inputs associated with the portion of the game shown on shared display system 102. Other forms of gaming machines through which aspects of the invention may be implemented may include switches, joysticks, or other mechanical input devices, in addition to the virtual buttons and other controls implemented on touch-screen button panel 706. For example, primary video display device 704 in gaming machine 700 provides a convenient display device for implementing touch screen controls in addition to or in lieu of controls included on touch-screen button panel 706 or mechanical controls. The player interface devices which receive player inputs in the course of a game played through the gaming machine, such as controls to select a wager amount for a given play, controls to enter a play input to actually start a given play in the wagering game, or controls to allow a player to make other player inputs in a game according to the present invention, may be referred to generally as a "player input system."

It will be appreciated that gaming machines may also include a number of other player interface devices in addition to devices that are considered player controls for use in entering inputs in the course of a particular game. Gaming machine 700 also includes a currency/voucher acceptor having an input ramp 712, a voucher/receipt printer having a voucher/receipt output 715, and a player card reader (not shown in the view of FIG. 7). Numerous other types of player interface devices may be included in gaming machines that may be used to implement embodiments of the present invention.

Gaming machine 700 may also include a sound system to provide an audio output to enhance the user's playing experience. For example, illustrated gaming machine 700 includes speakers 716 which may be driven by a suitable audio amplifier (not shown) to provide a desired audio output at the gaming machine.

FIG. 8 shows a logical and hardware block diagram 800 of gaming machine 700 which includes a processor (CPU) 805 along with random access memory (RAM) 806 and nonvolatile memory or storage device 807. All of these devices are connected on a system bus 808 with an audio controller device 809, a network controller 810, and a serial interface 811. A graphics processor 815 is also connected on bus 808 and is connected to drive primary video display device 704 and secondary video display device 707 (both mounted on cabinet 701 as shown in FIG. 7). A second graphics processor 816 is also connected on bus 808 in this example to drive the auxiliary display devices 808 and 809 also shown in FIG. 7. As shown in FIG. 8, gaming machine 700 also includes a touch screen controller 817 connected to system bus 808. Touch screen controller 817 is also connected via signal path 818 to receive signals from a touch screen element associated with primary video display device 704 or touch-screen button panel 706 or both. It will be appreciated that the touch screen element itself typically comprises a thin film that is secured over the display surface of the respective display device such as the display device of touch-screen button panel 706 in FIG. 7. The touch screen element itself is not illustrated or referenced separately in the figures.

Those familiar with data processing devices and systems will appreciate that other basic electronic components will be included in gaming machine 700 such as a power supply, cooling systems for the various system components, audio amplifiers, and other devices that are common in gaming machines. These additional devices are omitted from the drawings so as not to obscure the present invention in unnecessary detail.

All of the elements 805, 806, 807, 808, 809, 810, and 811 shown in FIG. 8 are elements commonly associated with a personal computer. These elements may be mounted on (or connected to) a standard personal computer motherboard and housed in a standard personal computer housing which itself may be mounted in cabinet 701 shown in FIG. 7. Alternatively, the various electronic components may be mounted on one or more circuit boards housed within cabinet 701 without a separate enclosure such as those found in personal computers. Those familiar with data processing systems and the various data processing elements shown in FIG. 8 will appreciate that many variations on this illustrated structure may be used within the scope of the present invention. For example, since serial communications are commonly employed to communicate with a touch screen controller such as touch screen controller 817, the touch screen controller may not be connected on system bus 808, but instead include a serial communications line to serial interface 811, which may be a USB controller for example. It will also be appreciated that some of the devices shown in FIG. 8 as being connected directly on system bus 808 may in fact communicate with the other system components through a suitable expansion bus. Audio controller 809, for example, may be connected to the system via a PCI or PCIe bus. System bus 808 is shown in FIG. 8 merely to indicate that the various components are connected in some fashion for communication with CPU 805 and is not intended to limit the invention to any particular bus architecture. Numerous other variations in the gaming machine internal structure and system may be used without departing from the principles of the present invention. For example, a gaming machine in some embodiments of the present invention may rely on one or more data processors which are located remotely from the gaming machine itself. Embodiments of the present invention may include no processor such as CPU 805 or graphics processors such as 815 and 816 at the gaming machine, and may instead rely on one or more remote processors. Thus unless specifically stated otherwise, the designation "gaming machine" is used in this disclosure and the accompanying claims to designate a system of devices which operate together to provide the indicated functions. A "gaming machine" may include a gaming machine such as gaming machine 700 shown in FIGS. 7 and 8, which is itself a system of various components, and may also include one or more components remote from a gaming machine cabinet (that is, cabinet 701 in FIG. 7). Thus the designation "gaming machine" encompasses both a stand-alone gaming machine and a gaming machine (that is, the part housed in a cabinet such as cabinet 701 in FIG. 7) along with one or more remote components for providing various functions (such as accounting functions or other functions associated with game play).

Graphics processors are also commonly a part of modern computer systems. Although separate graphics processor 815 is shown for controlling primary video display device 704 and secondary video display device 707, and graphics processor 816 is shown for controlling both auxiliary display devices 808 and 809, CPU 805 or a graphics processor packaged with or included with CPU 805 may control all of the display devices directly without any separately packaged graphics processor. The invention is not limited to any particular arrangement of processing devices for controlling the video display devices included with gaming machine 700. Also, a gaming machine implementing the present invention is not limited to any particular number of video display devices or other types of display devices.

In the illustrated gaming machine 700, CPU 805 executes software, that is, program code, which ultimately controls the entire gaming machine including the receipt of player inputs and the presentation of the graphics or information displayed according to the invention through the display devices 704, 707, 708, and 709 associated with the gaming machine. CPU 805 also executes software related to communications handled through network controller 810, and software related to various peripheral devices such as those connected to the system through audio controller 809, serial interface 811, and touch screen controller 817. CPU 805 may also execute software to perform accounting functions associated with game play. Random access memory 806 provides memory for use by CPU 805 in executing its various software programs while the nonvolatile memory or storage device 807 may comprise a hard drive or other mass storage device providing storage for game software, including game software 804 (gaming machine program code) prior to loading into random access memory 806 for execution, or for programs not in use or for other data generated or used in the course of gaming machine operation. Network controller 810 provides an interface to other components of a gaming system in which gaming machine 700 may be included. An example network will be described below in connection with FIG. 9.

It should be noted that the invention is not limited to gaming machines employing the personal computer-type arrangement of processing devices and interfaces shown in example gaming machine 700. Other gaming machines through which the invention may be implemented may include one or more special purpose processing devices to perform the various processing steps for implementing the invention. Unlike general purpose processing devices such as CPU 805, which may comprise an Intel Pentium® or Core® processor for example, these special purpose processing devices may not employ operational program code to direct the various processing steps.

The example gaming machine 700 is shown in FIG. 8 as including user interface devices 820 (part of a player input system) connected to serial interface 811. These user interface devices 820 may include various player input devices such as mechanical buttons shown on touch-screen button panel 706 in FIG. 7, and/or levers, and other devices. It will be appreciated that the interface between CPU 805 and other player input devices such as player card readers, voucher readers or printers, and other devices may be in the form of serial communications. Thus serial interface 811 may be used for those additional devices as well, or the gaming machine may include one or more additional serial interface controllers. However, the interface between peripheral devices in the gaming machine, such as player input devices, is not limited to any particular type or standard for purposes of the present invention.

Reel Assembly 813 is shown in the block diagram of FIG. 8 to illustrate that a gaming machine which may be used in a shared display system according to the present invention may also include mechanical reels. For example, a number of sets of mechanical reels may replace the primary display device 704, or at least part of that display device. Alternatively, mechanical reels may be included in the gaming machine behind a light-transmissive video display panel. In either case, the mechanical reels represent a display device for displaying various game symbols in the course of a game play. Although the invention is not limited to any particular mechanical reel arrangement or control system, mechanical reels may be controlled conveniently through serial communications which provide instructions for a respective stepper motor for each reel. Thus some embodiments of the present invention which employ mechanical reels may use a serial interface device such as serial interface 811 to control communications with the reel assembly, and may not include a direct bus interconnection as indicated by FIG. 8. Details of a mechanical reel arrangement and various accent lighting arrangements which may be associated with mechanical reels will not be described further here since such details are not necessary for an understanding of shared display and game presentation arrangements which embody the present invention.

Referring now to FIG. 9, a networked gaming system 900 associated with one or more gaming facilities may include one or more networked gaming machines 700 ("electronic gaming machines" or "EGM's") connected in the network by suitable network cable or wirelessly. Networked gaming machines 700 (EGM1-EGMn) and one or more shared display systems 913 may be operatively connected so as to provide shared game presentations according to the present invention for associated gaming machines 700. Shared display system 913 may correspond to the system 102 shown above in FIGS. 1-3 and any of the EGMs 700 may be situated with respect to the shared display system similarly to gaming machines 120*a-f* in FIGS. 1-2.

The example gaming network 900 shown in FIG. 9 includes a host server 901 and floor server 902, which together may function as an intermediary between floor devices such as gaming machines 700 and back office devices such as the various servers described below. Game server 903 may provide server-based games and/or game services to network connected gaming devices such as gaming machines 700. Central determinant server 905 may be included in the network to identify or select lottery, bingo, or other centrally determined game outcomes and provide the outcome information to networked gaming machines 700 which present the games to players.

Tournament server 906 may be included in the system for controlling or coordinating tournament functions. These functions may include maintaining tournament player scores and ranking in real time during the course of tournament play, and communicating this information to the various gaming machines 700 participating in the tournament. Tournament server 906 may also function to enroll players in tournaments, schedule tournaments, and maintain the time remaining in the various tournaments.

Progressive server 907 may maintain progressive pools for progressive games which may be available through the various gaming machines 700. In some implementations, progressive server 907 may simply receive communications indicating contribution amounts which have been determined by processes executing at the various gaming machines 700 or elsewhere in the gaming network. Alternatively, progressive server 907 may perform processes to determine the contribution amounts for incrementing the various progressive pools which may be maintained. Progressive server 907 may also periodically communicate current pool values back to the various gaming machines 700, and may participate in communicating awarded progressive prize amounts to the gaming machines and making adjustments to the progressive prize pools accordingly. In some implementations, progressive server 907 may also determine or participate in determining when a progressive prize triggering event occurs.

Accounting server 911 may receive gaming data from each of the networked gaming devices, perform audit functions, and provide data for analysis programs. Player account server 909 may maintain player account records, and store persistent player data such as accumulated player points and/or player preferences (for example, game personalizing selections or options).

Example gaming network 900 also includes a gaming website 921 which may be hosted through web server 920 and may be accessible by players via the Internet. One or more games may be displayed as described herein and played by a player through a personal computer 923 or handheld wireless device 925 (for example, a Blackberry® cell phone, Apple® iPhone®, personal digital assistant (PDA), iPad®, etc.). To enter website 921, a player may log in with a user name that may, for example, be associated with the player's account information stored on player account server 909. Once logged in to website 921 the player may play various games on the website, including games according to the invention. Also website 921 may allow the player to make various personalizing selections and save the information so it is available for use during the player's next gaming session at a casino establishment having the gaming machines 700.

It will be appreciated that gaming network 900 illustrated in FIG. 9 is provided merely as an example of a gaming network in which shared display systems such as system 913 may be included, and is not intended to be limiting in any way. Shared display systems according to aspects of the present invention are not limited to use with gaming networks such as network 900.

As used herein, whether in the above description or the following claims, the terms "comprising," "including," "carrying," "having," "containing," "involving," and the like are to be understood to be open-ended, that is, to mean including but not limited to. Also, it should be understood that the terms "about," "substantially," and like terms used herein when referring to a dimension or characteristic of a component indicate that the described dimension/characteristic is not a strict boundary or parameter and does not exclude variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Any use of ordinal terms such as "first," "second," "third," etc., in the following claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The term "each" may be used in the following claims for convenience in describing characteristics or features of multiple elements, and any such use of the term "each" is in the inclusive sense unless specifically stated otherwise. For example, if a claim defines two or more elements as "each" having a characteristic or feature, the use of the term "each" is not intended to exclude from the claim scope a situation having a third one of the elements which does not have the defined characteristic or feature.

The above described preferred embodiments are intended to illustrate the principles of the invention, but not to limit the scope of the invention. Various other embodiments and modifications to these preferred embodiments may be made by those skilled in the art without departing from the scope of the present invention. For example, in some instances, one or more features disclosed in connection with one embodiment can be used alone or in combination with one or more features of one or more other embodiments. More generally, the various features described herein may be used in any working combination.

The invention claimed is:

1. A gaming system including:

(a) a first gaming machine operatively connected in a network of at least two gaming machines, the first gaming machine including a first gaming machine display system and a first gaming machine player input system, the first gaming machine being operable to, (i) in response to a play initiating input entered through the first gaming machine player input system, cause the first gaming machine display system to display a first portion of a first game play and to, (ii) in response to a hand-off condition occurring in the first game play, initiate a hand-off communication for the first game play;

(b) a second gaming machine operatively connected in the network of at least two gaming machines, the second gaming machine including a second gaming machine display system and a second gaming machine player input system, the second gaming machine being operable to, (i) in response to a play initiating input entered through the second gaming machine player input system, cause the second gaming machine display system to display a first portion of a second game play and to, (ii) in response to a hand-off condition occurring in the second game play, initiate a hand-off communication for the second game play;

(c) a shared display arrangement mounted in a viewable position relative to the first gaming machine and second gaming machine, the shared display arrangement including at least three shared game display devices, each respective shared game display device including a respective display input for receiving respective display driving signals separately from each other shared game display device; and (d) a shared display server having a number of video output ports, each respective video output port being operably connected to the display input of a respective one of the shared game display devices, the shared display server also having a network port which is separate from any of the video output ports and which is operably connected to the network of at least two gaming machines for communication with the first gaming machine to receive the hand-off communication for the first game play and for communication with the second gaming machine to receive the hand-off communication for the second game play, the shared display server being operable to, (i) after receipt of the hand-off communication for the first game play, cause the shared display arrangement to display a presentation for a second portion of the first game play, the second portion of the first game play being independent of any game play initiated at any other gaming machine in the network of at least two gaming machines and the presentation for the second portion of the first game play including for each respective shared game display device a respective first game reel spin simulation performed under control of a respective first game display driving signal from a respective one of the video output ports of the shared display server, and (ii) after receipt of the hand-off communication for the second game play, cause the shared display arrangement to display a presentation for a second portion of the second game play, the second portion of the second game play being independent of any game play initiated at any other gaming machine in the network of at least two gaming machines and the presentation for the second portion of the second game play including for each shared game display device a respective second game reel spin simulation performed under control of a respective second game display driving signal from a respective one of the video output ports of the shared display server, the second portion of the first game play being distinct from the second portion of the second game play.

2. The gaming system of claim 1 wherein:

(a) the first gaming machine is also operable to cause the first gaming machine display system to display a shared display system message when the shared display arrangement displays the presentation for the second portion of the first game play; and (b) the second gaming machine is operable to cause the second gaming machine display system to display the first portion of the second game play while the shared display arrangement displays the presentation for the second portion of the first game play.

3. The gaming system of claim 1 wherein:

(a) the second gaming machine is also operable to, (i) in response to a third play initiating input entered through the second gaming machine player input system, cause the second gaming machine display system to display a first portion of a third game play and to, (ii) in response to a hand-off condition occurring in the third game play, initiate a hand-off communication for the third game play;

(b) the shared display server is also operable initiate a queuing communication to the second gaming machine in response to receipt of the hand-off communication for the third game play while the shared display arrangement is displaying a presentation for a second portion of another game play; and (c) the second gaming machine is also operable to cause the second gaming machine display system to display a queuing message indicating a position in line for the shared display arrangement in response to receipt of the queueing communication.

4. The gaming system of claim 3 wherein the second gaming machine is also operable to cause the second gaming machine display system to place a local play option control in an activated state in response to receipt of the queueing communication.

5. The gaming system of claim 4 wherein the second gaming machine is also operable to cause the second gaming machine display system to display the presentation of the second portion of the third game play in response to a local play input received through the local play option control.

6. The gaming system of claim 1 wherein the shared display server is also operable to cause the shared display arrangement to display a presentation of an additional level of the second portion of the first game play in response to an additional level trigger in the second portion of the first game play, the additional level of the second portion of the first game play comprising a multiple-reel reel spin simulation performed on a respective one of the shared game display devices located immediately above the first gaming machine.

7. A shared game display system for a gaming system including two or more gaming machines connected to a communication system, the shared game display system including:

(a) a shared display arrangement in a viewable position relative to the two or more gaming machines, the shared display arrangement including at least three shared game display devices, each respective shared game display device including a respective display input for receiving respective display driving signals separately from each other shared game display device; and (b) a shared display server having a number of video output ports, each respective video output port being operably connected to the display input of a respective one of the shared game display devices, the shared display server also having a network port which is separate from any of the video output ports and which is operably connected to the communication system to facilitate communications with each of the two or more gaming machines, the shared display server being operable to:

(i) receive through the network port a first hand-off communication from a first one of the two or more gaming machines, the received first hand-off communication being associated with a first game play which has been initiated at the first one of the two or more gaming machines, (ii) responsive to the first hand-off communication, direct a first shared display control signal to the shared display arrangement to cause the shared display arrangement to present a portion of the first game play which is independent of any game play initiated at any other gaming machine of the two or more gaming machines, the presentation for the portion of the first game play including for each respective shared game display device a respective first game reel spin simulation performed under control of a respective first game display driving signal from a respective one of the video output ports of the shared display server, (iii) receive through the network port a second hand-off communication from a second one of the two or more gaming machines, the received second hand-off communication being associated with a second game play which has been initiated at the second one of the two or more gaming machines, (iv) responsive to the second hand-off communication, direct a second shared display control signal to the shared display arrangement to cause the shared display arrangement to present a portion of the second game play which is independent of any game play initiated at any other gaming machine of the two or more gaming machines, the presentation for the portion of the second game play including for each shared game display device a respective second game reel spin simulation performed under control of a respective second game display driving signal from a respective one of the video output ports of the shared display server, wherein the portion of the second game play is distinct from the portion of the first game play.

8. The shared game display system of claim 7 wherein the shared display server is also operable initiate a queuing communication to the second one of the two or more gaming machines when the second hand-off communication is received at a time that the shared display arrangement is presenting a portion of the first game play.

9. The shared game display system of claim 7 wherein the shared display server is also operable to, in response to an additional level trigger, cause the shared display arrangement to display a presentation of an additional level of the portion of the first game play, the additional level of the portion of the first game play comprising a multiple-reel reel spin simulation performed on a respective one of the shared game display devices located immediately above the first one of the two or more gaming machines.

10. The shared game display system of claim 7 wherein the at least three shared game display devices face in a first direction and the shared display arrangement further includes at least three additional shared game display devices facing in a second direction offset approximately 180 degrees to the first direction.

11. A method including:

(a) receiving a first play initiating input entered at a player input system of a first gaming machine included in a set of two or more gaming machines, and receiving a second play initiating input entered at a second player input system of a second gaming machine included in the set of two or more gaming machines;

(b) responsive to the first play initiating input, displaying a first portion of a first game play with a display system of the first gaming machine, and responsive to the second play initiating input, displaying a first portion of a second game play with a display system of the second gaming machine;

(c) responsive to a first shared display condition occurring for the first game play, making a first hand-off communication from the first gaming machine to a shared display server, and responsive to a second shared display condition occurring for the second game play, making a second hand-off communication from the second gaming machine to the shared display server, the shared display server including a number of video output ports and a network port separate from any of the video output ports, and wherein the first hand-off communication and second hand-off communication are each received at the shared display server through the network port;

(d) after receipt of the first hand-off communication, displaying a presentation for a second portion of the first game play at a shared display arrangement under control of the shared display server in lieu of displaying the presentation of the second portion of the first game play at the first gaming machine, and after receipt of the second hand-off communication, displaying a presentation for a second portion of the second game play at the shared display arrangement under control of the shared display server in lieu of displaying the presentation of the second portion of the second game play at the second gaming machine, wherein the shared display arrangement includes at least three shared game display devices, each respective shared game display device including a respective display input for receiving respective display driving signals from a respective video output port of the number of video output ports of the shared display server separately from each other shared game display device, and wherein the presentation for the second portion of the first game play and the presentation for the second portion of the second game play each include for each respective shared game display device a respective reel spin simulation performed under control of a respective display driving signal from a respective one of the video output ports of the number of video output ports of the shared display server, and wherein the second portion of the first game play and the second portion of the second game play are each independent of any game play initiated at any other gaming machine in the set of two or more gaming machines; and (e) upon completion of the first and second portions of the first game play awarding a payout for the first and second portions of the first game play though a payout system of the first gaming machine, and upon completion of the first and second portions of the second game play awarding a payout for the first and second portions of the second game play though a payout system of the second gaming machine.

12. The method of claim 11 further including:

(a) receiving a third play initiating input entered at the player input system of the second gaming machine, and responsive to the third play initiating input, displaying a first portion of a third game play with the display system of the second gaming machine; and (b) responsive to a third shared display condition occurring for the third game play, determining if the shared display arrangement is available to display the second portion of the third game play, and wherein, when the shared display arrangement is not available to display the second portion of the third game play, displaying a queueing message at the display system of the second gaming machine, the queuing message indicating a position in line for the shared display arrangement.

13. The method of claim 12 further including, in addition to displaying the queuing message, activating a local play option control at the second gaming machine.

14. The method of claim 13 further including, in response to a local play selection input entered through the local play option control, displaying a presentation for the second portion of the third game play at the display system of the second gaming machine.

15. The method of claim 11 further including, responsive to an additional level trigger for the second portion of the first game play, displaying a presentation for an additional level of the second portion of the first game play, the additional level of the second portion of the first game play being displayed through the shared display arrangement under control of the shared display server and comprising a multiple-reel reel spin simulation performed on a respective one of the shared game display devices located immediately above the first gaming machine.

* * * * *